United States Patent [19]

Weinraub

[11] Patent Number: 4,836,061

[45] Date of Patent: Jun. 6, 1989

[54] KEYLESS DOOR UNLOCKING APPARATUS FOR AUTOMOBILES

[76] Inventor: Adam Weinraub, 2760 South Harbor Blvd., #H, Santa Ana, Calif. 92704

[21] Appl. No.: 263,080

[22] Filed: Oct. 27, 1988

[51] Int. Cl.[4] ..... E05B 19/20

[52] U.S. Cl. ..... 81/15.9

[58] Field of Search ..... 81/488, 15.9; 70/465, 70/394; 294/19.1

[56] References Cited

U.S. PATENT DOCUMENTS

| | | | |
|---|---|---|---|
| 2,027,009 | 1/1936 | Wyscaver | 81/15.9 |
| 3,438,290 | 4/1969 | Konopacki | 81/15.9 |
| 4,144,778 | 3/1979 | Waring | 81/15.9 |
| 4,608,886 | 9/1986 | Bolton | 81/15.9 |

*Primary Examiner*—Roscoe V. Parker, Jr.
*Attorney, Agent, or Firm*—Gary Appel

[57] ABSTRACT

Keyless apparatus for unlocking from the outside doors of automobiles having door locks comprises a slender, stiff rod formed having a tight U-bend defining an elongate, first leg portion and a shorter, second leg portion. The second leg portion has, at its upper end a relatively large, inverted U-shaped portion with a relatively short depending third leg portion which terminates in a short, elastomeric coated hook which, in turn, projects inwardly towards the first and second leg portions. The first and second leg portions are substantially parallel with one another and the first, second, and third leg portions lie substantially in a common plane. The first leg portion is about 16 inches long, the second leg portion is about 12 inches long to the top of the inverted U-shaped bend, and the third leg portion is about 6 inches long from the top of the inverted U-shaped bend. The free end of the first leg portion terminates in a manipulating end portion which is at an angle of between about 20° and about 60° relative to the first leg portion so as to extend outwardly relative thereto. The manipulating portion of the apparatus comprises a relatively straight portion of the rod which is substantially coplanar with the first leg portion and which terminates in a finger grip ring which is coplanar with the manipulating portion. A variation apparatus is described in which the third leg portion has a dog-leg bend in it.

28 Claims, 2 Drawing Sheets

KEYLESS DOOR UNLOCKING APPARATUS FOR AUTOMOBILES

BACKGROUND OF THE INVENTION

1. Field of the Invention

The present invention relates generally to apparatus for enabling keyless entry into locked automobiles without damage to the automobiles, and more particularly to apparatus which is inserted into a locked automobile door along the outside of closed door windows and which operationally engages door lock actuators on the door panel inside of the automobile door.

2. Discussion of the Background

Many occasions exist in which legal entry into a locked automobile (or truck), without the use of a key to the automobile and without damage to the automobile, is desired or necessary. It is, for example, a common occurrence for drivers to lock themselves out of their automobiles by inadvertently locking all the doors—with the windows closed—with the entry key either still in the ignition switch or elsewhere in the automobile. In other instances, locked and illegally-parked automobiles may have to be entered by police or tow truck operators to enable the automobile to be towed away. In still other instances, it may be necessary for legal authorities to enter locked automobiles to make legal searches for contraband or explosives, to investigate crimes or, in some cases, to enable the automobiles to be moved out of the way of other vehicles in the case of emergencies and natural disasters.

Although automobile master keys may be available to police departments and other authorized agencies, key sets sufficient for entry into all types and models of automobiles are numerous and expensive and are, therefore, not generally made available to ordinary tow truck operators, fire departments, or security personnel who most commonly are faced with the day-to-day problems of gaining entry into locked automobiles. Although, in emergency situations, automobile windows can be broken to enable unlocking of automobiles from the inside, such means for entry obviously necessitate the replacement of the broken window, often at considerable expense, and may otherwise subject the individual, company, or agency which was responsible for the damage to legal action by the automobile owner.

It has, however, long been known by police, tow truck operators, and others whose occupations frequently require legal entry into locked automobiles that automobile door locking linkages inside automobile doors can often be manipulated by a person outside the automobile in a manner which will unlock the door. A common tool for such door unlocking linkage manipulation is a slender, flat strip of metal with a notch cut in one end. Such a tool, which is frequently referred to as a "Slim Jim", is slipped downwardly along a closed window into a locked door and is manipulated by the operator until the hooked end of the strip catches some part of the lock linkage, usually a longitudinally, extending link. When the metal strip has engaged the lock link in such a manner, an upward pull on the strip is generally all that is needed to move the linkage sufficiently to unlock the door. In the hands of an experienced operator, a Slim Jim can be used to unlock many automobile doors almost as quickly as they can be unlocked using a proper factory key.

As mentioned above, many automobiles are constructed with inside door lock linkages which enable the unlocking of the door by being pulled upwardly, as by a common Slim Jim. Typical of such types of automobiles are those whose door locks are mechanically actuated by push-pull lock "buttons" which commonly project upwardly from the top of the inside door frame. As also mentioned above, such types of automobile door locks are usually capable of being manipulated by a Slim Jim, such that the doors can be quickly and easily unlocked from the outside with no damage to the automobile.

Some other types of automobile door locks, however, employ a different type of manual door locking linkage which requires a fore or aft pull, instead of an upward pull, to release the door lock Exemplary of automobiles employing this type of door locking linkages are various makes and models of automobiles manufactured by the General Motors Corporation of the United States Slim Jims of the type described above are generally ineffective in manipulating this particular type of door lock linkage because the flat strips provide no means whereby the linkages can be gripped tightly enough to enable the necessary fore or aft unlocking movement thereof.

To enable the keyless unlocking of this particular type of door lock, there is available a keyless door unlocking apparatus which is somewhat in the general nature of a Slim Jim. This apparatus can also be slid downwardly into a locked door from the outside and along a closed window, and is configured so that an internal locking linkage can be effectively gripped to enable fore or aft unlocking movement of the linkage. This particular keyless door unlocking apparatus is described in U.S. Pat. No. 4,608,886, which was issued on Sept. 2, 1986.

There are, however, still other types of automobile door locks which cannot, or cannot readily, be opened by the use of either conventional Slim Jims or by the aforementioned type of keyless unlocking apparatus disclosed in the above-cited patent. Typical of such type of door locks are electrically-operated door locks which use electrical solenoids or motors to operate the door locks, the locking levers being generally merely electrical switches of some type, including slide switches on the inside door panel or arm rest, or what otherwise appear to be conventional push-pull door lock "buttons". With such type of electrically-actuated door locks, there are generally no linkages, or the like, within the automobile doors which can be manipulated by any type of externally-inserted mechanical implement.

To the contrary, to unlock automobile doors having electrically-actuated door locks, it is generally necessary to operate the door lock switches on the inside of the door panels. As can be readily appreciated, such operation from outside an automobile with locked doors and closed windows is an extremely difficult task to accomplish, especially if it is desired or necessary not to damage the automobile in any manner. Because of the problems presented by the damage-free, keyless unlocking from the outside of such electrically-operated door locks, as well as possibly of some types of mechanical door locks which have in-door lock linkages which are relatively inaccessible from outside the door, the present inventor has invented a new keyless door unlocking apparatus which is insertable into a locked automobile door along the outside of the closed window thereof. The present apparatus is configured so that, upon manipulation of the apparatus, door lock switches mounted on the inside door panel, molding at the top of the inside door panel, or the arm rest on the door panel can be actuated from the outside of the closed and locked door without damaging the or its associates window and paneling.

It is, however, emphasized that the present invention is intended solely for use in a lawful manner, by legally-operated tow trucks, by police and fire departments, and by locksmiths and other civil and governmental organizations, which are legally empowered and have a lawful right to enter locked automobiles with or without the automobile owner's authorization.

SUMMARY OF THE INVENTION

According to the present invention, there is provided an apparatus for the keyless unlocking of locked doors of automobiles and the like from outside the door when the door window is closed and without damaging the door or window. The apparatus is particularly adapted for opening locked automobile doors which have a door-locking switch or lever mounted on the inside door panel, the inside door panel window sill, or an arm rest on the inside door panel. The keyless door unlocking apparatus comprises a slender, stiff rod formed having a tight U-bend which defines an elongate, first leg portion and a shorter, second leg portion which has at its upper end a relatively large, inverted U-shaped portion with a relatively short depending third leg which terminates in a short hook which projects inwardly towards the first and second leg portions. Preferably, the hook portion is coated with an elastomeric coating so as to be non-slipping.

According to a preferred embodiment, the first and second leg portions are substantially parallel with one another and the first, second, and third leg portions lie substantially in a common plane. Preferably, for most automobiles, the first leg portion is about 16 inches long, the second leg portion is about 12 inches long to the top of the inverted U-shaped bend, and the third leg portion is about 6 inches long from the top of the inverted U-shaped bend.

The free end of the first leg portion preferably terminates in a manipulating end portion which is at an angle of between about 20° and about 60° relative to the first leg portion. It is preferred that the manipulating portion comprise a relatively straight portion of the rod which is substantially coplanar with the first leg portion, and that it terminate in a finger grip ring which is coplanar with the manipulating portion.

In a variation keyless door unlocking apparatus, the third leg portion is bent so as to angle outwardly away from the second leg portion and is then angled back inwardly towards the second leg portion. In this variation, it is preferred that the bend angle in the third leg portion is between about 20° and about 60°.

There is thereby formed an effective, yet relatively inexpensive apparatus for the keyless unlocking of locked automobile doors from the outside when the door windows are closed, and for performing such unlocking operation without damage to the automobile door.

BRIEF DESCRIPTION OF THE DRAWINGS

The present invention can be more readily understood from the following detailed description, when taken in conjunction with the accompanying drawings, in which.

Figure 1:
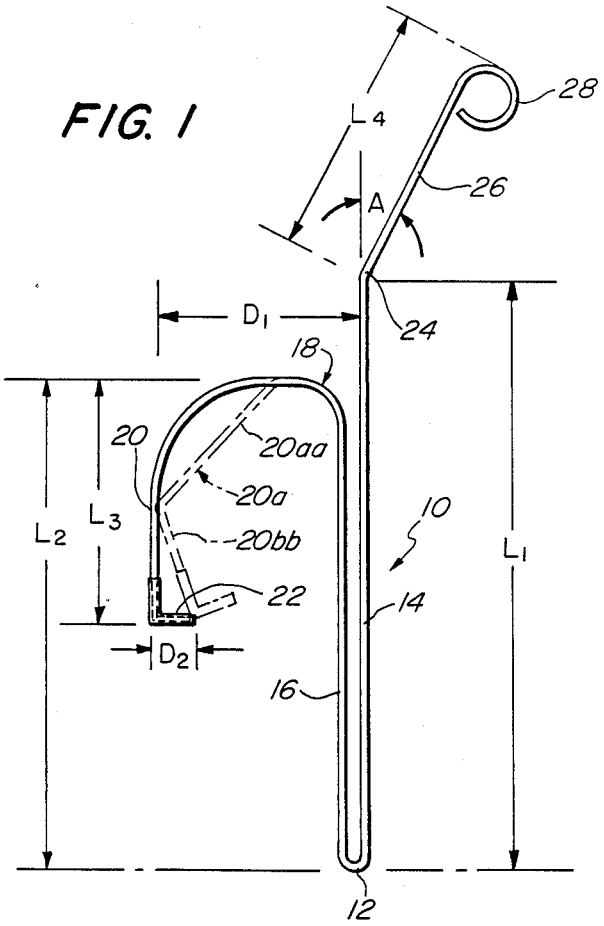
FIG. 1 is a front view of a keyless automobile door unlocking apparatus of the present invention, showing the overall shape of the apparatus; and, FIG. 2 is a sequence of four (4) pictorial diagrams which illustrate the manner in which the apparatus of FIG. 1 is operated to unlock a closed automobile door having a closed window.
Figure 2A:
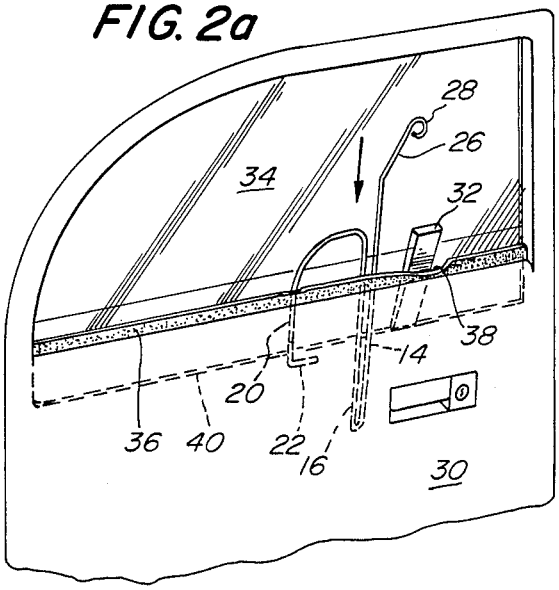
Figure 2B:
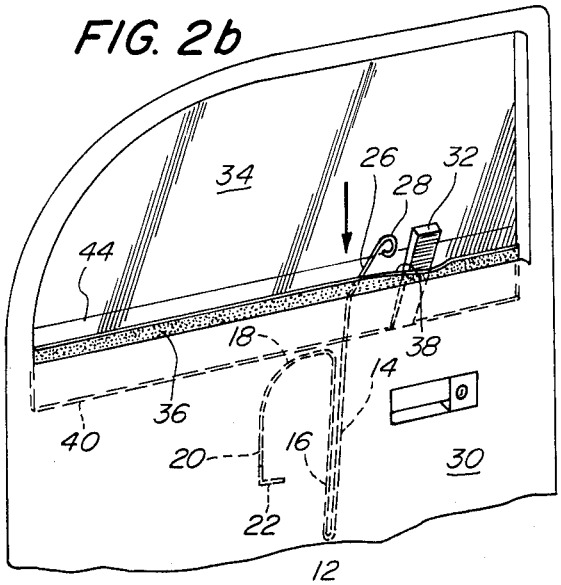
Figure 2C:
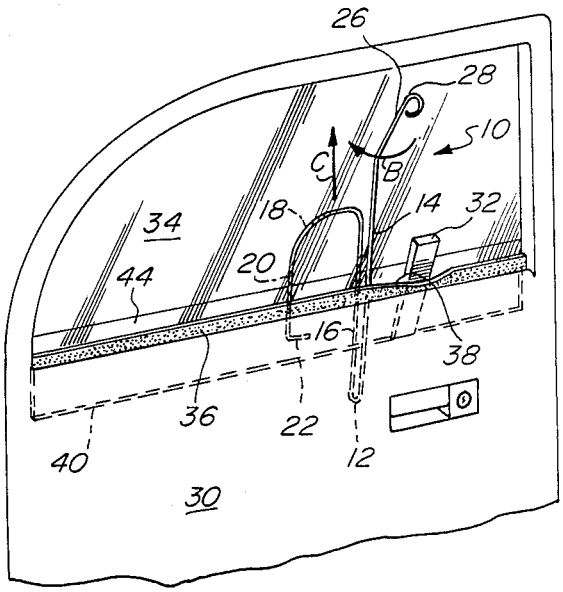
Figure 2D:
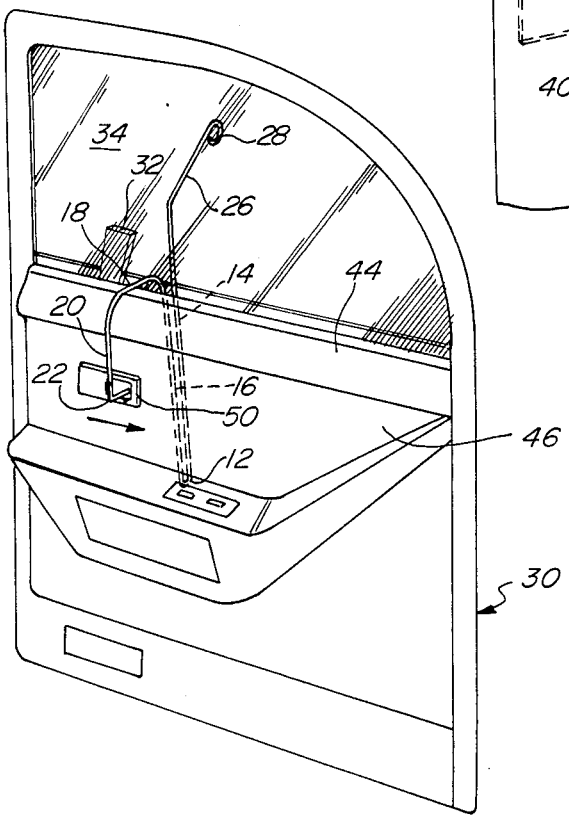

(i) FIG. 2*a* being a view of the outside of the door being unlocked and showing the manner in which the door unlocking apparatus of FIG. 1 is inserted into the inside of the door along the outside of the closed window;

(ii) FIG. 2*b* being another outside view of the same door as shown in FIG. 2*a*, showing the apparatus inserted its full working distance into the door;

(iii) FIG. 2*c* being still another outside view of the same door as shown in FIGS. 2*a* and 2*c*, showing the door unlocking apparatus slightly rotated and being withdrawn from the door in a manner causing lower regions of the apparatus to be withdrawn from the door on the inside of the door; and, (iv) FIG. 2*d* is a view of the inside of the door of FIGS. 2*a* through 2*c*, showing the door unlocking apparatus manipulated in a manner moving a door locking lever on the inside door panel in a direction causing actuation of a door lock in the door and the subsequent unlocking of the door.

When the same elements and features are shown in more than one FIG., they are given the same reference numbers in all such FIGS.

DESCRIPTION OF THE PREFERRED EMBODIMENT

Shown in FIG. 1 is an automobile keyless door unlocking apparatus or tool 10 which is especially adapted, as will become apparent from the following description, for use in the keyless unlocking of an automobile (including trucks).

Keyless unlocking apparatus 10 is preferably bent from a stiff, slender steel rod, which preferably has a diameter of about 0.125 inches. As shown in FIG. 1, the rod from which apparatus 10 is formed is bent, in about the middle, through about 180° in a tight U-shaped bend 12 so as to form a first, elongate straight leg portion 14, having a length equal to $L_1$, on one side of bend 12 and a shorter, straight second leg portion 16, having an overall length, to the top of a relatively large diameter bend 18, equal to $L_2$, on the other side of the bend. Respective first and second leg portions 14 and 16 are preferably about parallel to one another, although, as indicated in FIG. 1, these two (2) leg portions may be slightly closer together in upper regions. It is also preferred that first and second leg portions 14 and 16 lie in a common plane. In fact, as more particularly described below, it is preferred that all of apparatus 10 lie in a common plane.

A third leg portion 20 is formed by bend 18 opposite to, and preferably coplanar with, second leg portion 16. The overall length of third leg portion 20, from the top of bend 18 is equal to $L_3$, and the third leg portion is preferably about parallel to second leg portion 16. The radius of bend 18 is such that respective second and third leg portions 16 and 20 are a distance, $D_1$, apart.

At the lower end of third leg portion 20, the rod forming apparatus 10 is bent at an angle of preferably about 90° so that a short hook portion 22 projects inwardly (sidewardly) towards second leg portion 16, for a distance, $D_2$. It is preferred, although not essential, that hook portion 22 and lower end regions material, such as with the type of liquid rubber or plastic which is readily available for coating the handles of hand tools.

At the upper end of first leg portion 14, the rod forming apparatus 10 is bent, at a bend 24, outwardly (away from the first leg portion) through an angle "A", which may be between about 20° to about 60°, and is more preferably about 35°, so as to form a manipulating portion 26 of the apparatus. Manipulating portion 26 preferably terminates, at its free end, in a relatively small diameter loop 28 which enables an operator to easily grasp and may have a diameter sufficient manipulate apparatus 10. Loop 28 to permit the entry therethrough of an operator distance from bend 24 and the top of loop 28 is equal to $L_4$, as is shown in FIG. 1.

As was mentioned above, it is preferred that respective first, second, and third leg portions 14, 16, and 20, hook portion 22; and manipulating portion 26 (including loop 28) preferably all lie in a common plane so that apparatus is easy to insert along the outside of a closed automobile window and downwardly into an automobile door (as depicted in FIG. 2, and as is described below).

By way of specific example, with no limitations being thereby intended or implied, the length, $L_1$, of first leg portion 14 may be about 16 inches; the length, $L_2$, of second leg portion 16 may be about 12 inches; the length, $L_3$, of third leg portion 20 may be about 6 inches; and the length, $L_4$, of manipulating portion 26 may also be about −6 inches.

OPERATION

FIGS. 2*a* through 2*d* depict the manner in which keyless door unlocking apparatus 10 is operated to unlock a closed and locked door 30 A small wedge 32, for example, made of wood or plastic, is first inserted between the outside surface of a closed door window 34 and is slid downwardly between the window and a plastic rain guard strip 36 (which seals against the outside of the window to keep most of rain out of the inside of door 30). Wedge 32 thereby creates a small entry space 38 for apparatus 10, first and second leg portions 14 and 16 of which are slid downwardly along the outside of window 32, through the entry space into the inside of door 30 (FIG. 2*a*).

Insertion of first and second leg portions 14 and 16 of apparatus 10 is continued until the top of bend 18 is at a level mounted along the bottom edge of window 34 below a frame member 40 (FIG. 2*b*).

At this point of insertion, apparatus 10 is slightly rotated, by manipulating portion 26, in the direction of arrow "B" (FIG. 2*c*) just sufficiently to bring bend 18 and second leg portion 16 to the inside of window 32. Apparatus 10 is then partially withdrawn from door 30 until hook portion 22 at the bottom of third leg portion 16 clears an inside sill portion 44 of an inside door panel 46 (FIG. 2*d*); at this point window 34 is sandwiched between first and second leg portions 14 and 16. Apparatus 10 is then further pivoted in the direction of arrow "B" until, as depicted in FIG. 2*c*, the apparatus is about 8 perpendicular to window 34.

Thereafter, as depicted in FIG. 2*d* apparatus 10 is inserted a little farther into door 30 and is manipulated from the outside of the door by manipulating portion 26 until hook portion 22 engages a door lock switch or lever 50 which, in this particular case, is mounted on door panel 46. Apparatus 10 is continued to be manipulated until door lock switch or lever 50 is moved sufficiently to unlock door 30.

When door 30 has been unlocked in the above-described manner, it is generally preferred that apparatus 10 not be removed from the door until the door has been opened. This is so that apparatus 10 can be more carefully guided back into and then upwardly out of door 30.

Although there is described above a specific embodiment of a keyless automobile door unlocking apparatus in accordance with the present invention for purposes of illustrating the manner in which the invention may be used to advantage, it is to be appreciated that the invention is not limited thereto. For example, as shown in phantom lines in FIG. 1, bend 18 and third leg portion 20 can be bent in different shapes for different door configurations. As depicted, a variation third leg portion 20*a* is formed having a "dog-leg" bend in it such that an upper portion 20*aa* is angled outwardly away from second leg portion 16 and a lower portion 20*bb* is angled back towards the second leg portion. Accordingly, this and any and all other modifications and variation which may occur to those skilled in the art are to be considered to fall within the scope and spirit of the invention as defined by the appended claims.

What is claimed is:

1. Apparatus for the keyless unlocking of locked doors of automobiles and the like from outside the door when the door window is closed and without damaging the door or window, said door having a door-locking switch or lever mounted on the inside door panel, the inside door panel window sill or an arm rest on the inside door panel, the apparatus comprising a slender, stiff rod formed having a tight U-bend defining an elongate, first leg portion and a shorter, second leg portion; said second leg portion having at the upper end thereof a relatively large, inverted U-shape portion with a relatively short depending third leg portion which terminates in a short hook which projects inwardly towards said first and second leg portions.

2. The keyless automobile door unlocking apparatus as claimed in claim 1, wherein said first and second leg portions are substantially parallel with one another.

3. The keyless automobile door unlocking apparatus as claimed in claim 1, wherein said first, second and third leg portions are coplanar.

4. The keyless automobile door unlocking apparatus as claimed in claim 1 wherein the free end of said first leg portion terminates in a manipulating end portion which angles outwardly from the first leg portion at an angle "A" relative to said first leg portion.

5. The keyless automobile door unlocking apparatus as claimed in claim 4, wherein said angle "A" is between about 20° and about 60°.

6. The keyless automobile door unlocking apparatus as claimed in claim 4, wherein said angle "A" is about 35°.

7. The keyless automobile door unlocking apparatus as claimed in claim 4, wherein said manipulating portion comprises a relatively straight portion of the rod which is substantially coplanar with said first leg portion.

8. The keyless automobile door unlocking apparatus as claimed in claim 4, wherein said manipulating portion terminates in a finger grip ring which is coplanar with said manipulating portion.

9. The keyless automobile door unlocking apparatus as claimed in claim 1, wherein the first leg portion is about 16 inches long.

10. The keyless automobile door unlocking apparatus as claimed in claim 1, wherein the second leg portion is about 12 inches long to the top of the inverted U-shaped bend.

11. The keyless automobile door unlocking apparatus as claimed in claim 1, wherein the third leg portion is about 6 inches from the top of the inverted U-shaped bend.

12. The keyless automobile door unlocking apparatus as claimed in claim 1, wherein said third leg portion is bent so as to angle outwardly away from the second leg portion and then angle inwardly back towards the second leg portion.

13. The keyless automobile door unlocking apparatus as claimed in claim 12, wherein the bend angle in said third leg portion is between about 20° and about 60°.

14. The keyless automobile door unlocking apparatus as claimed in claim 1, wherein the entire apparatus lies substantially in a common plane.

15. The keyless automobile door unlocking apparatus as claimed in claim 1, wherein the hook portion is coated with an elastomeric, non-slip coating.

16. Apparatus for the keyless unlocking of locked doors of automobiles and the like from outside the door when the door window is closed and without damaging the door or window, said door having a door-locking switch or lever mounted on the inside door panel, the inside door panel window sill or an arm rest on the inside door panel, the apparatus comprising a slender, stiff rod formed having a tight U-bend defining an elongate, first leg portion and a shorter, second leg portion; said second leg portion having at the upper end thereof a relatively large, inverted U-shaped portion with a relatively short depending third leg portion which terminates in a short hook which projects inwardly towards said first and second leg portions, said first and second leg portions being substantially parallel with one another and said first, second, and third leg portions lying substantially in a common plane.

17. The keyless automobile door unlocking apparatus as claimed in claim 16, wherein the free end of said first leg portion terminates in a manipulating end portion which is at an angle of between about 20° and about 60° relative to said first leg portion.

18. The keyless automobile door unlocking apparatus as claimed in claim 17, wherein said manipulating portion comprises a relatively straight portion of the rod which is substantially coplanar with said first leg portion, said manipulating portion terminating in a finger grip ring which is coplanar with said manipulating portion.

19. The keyless automobile door unlocking apparatus as claimed in claim 16, wherein the first leg portion is about 16 inches long, wherein the second leg portion is about 12 inches long to the top of the inverted U-shaped bend, and wherein the third leg portion is about 6 inches long from the top of the inverted U-shaped bend.

20. The keyless automobile door unlocking apparatus as claimed in claim 1 wherein said third leg portion is bent so as to angle outwardly away from the second leg portion and is then angled back inwardly towards the second leg portion, the bend angle in said third leg portion being between about 20° and about 60°.

21. The keyless automobile door unlocking apparatus as claimed in claim 16, wherein the hook portion is coated with an elastomeric, non-slip coating.

22. Apparatus for the keyless unlocking of locked doors of automobiles and the like from outside the door when the door window is closed and without damaging the door or window, said door having a door-locking switch or lever mounted on the inside door panel, the inside door panel window sill or an arm rest on the inside door panel, the apparatus comprising a slender, stiff rod formed having a tight U-bend defining an elongate, first leg portion and a shorter, second leg portion; said second leg portion having at the upper end thereof a relatively large, inverted U-shaped portion with a relatively short depending third leg portion which terminates in a short, hook which projects inwardly towards said first and second leg portions, said first and second leg portions being substantially parallel with one another and said first, second, and third leg portions lying substantially in a common plane; the first leg portion being about 16 inches long, the second leg portion being about 12 inches long to the top of the inverted U-shaped bend, and the third leg portion being about 6 inches long from the top of the inverted U-shaped bend.

23. The keyless automobile door unlocking apparatus as claimed in claim 22, wherein the free end of said first leg portion terminates in a manipulating end portion which is at an angle of between about 20° and about 60° relative to said first leg portion, said manipulating portion comprising a relatively straight portion of the rod which is substantially coplanar with said first leg portion, said manipulating portion terminating in a finger grip ring which is coplanar with said manipulating portion.

24. The keyless automobile door unlocking apparatus as claimed in claim 22, wherein said third leg is bent so as to angle outwardly away from the second leg portion and then angled back inwardly towards the second leg portion, the bend angle in said third leg portion being between about 20° and about 60°.

25. The keyless automobile door unlocking apparatus as claimed in claim 2, wherein the hook portion is coated with an elastomeric, non-slip coating.

26. Apparatus for the keyless unlocking of locked doors of automobiles and the like from outside the door when the door window is closed and without damaging the door or window, said door having a door-locking switch or lever mounted on the inside door panel, the inside door panel window sill or an arm rest on the inside door panel, the apparatus comprising a slender, stiff rod formed having a tight U-bend defining an elongate, first leg portion and a shorter, second leg portion; said second leg portion having at the upper end thereof a relatively large, inverted U-shaped portion with a relatively short depending third leg portion which terminates in a short hook which projects inwardly towards said first and second leg portions, said first and second leg portions being substantially parallel with one another and said first, second, and third leg portions lying substantially in a common plane, the first leg portion being about 16 inches long, the second leg portion being about 12 inches long to the top of the inverted U-shaped bend, and the third leg portion being about 6 inches long from the top of the inverted U-shaped bend; the free end of said first leg portion terminating in a manipulating end portion which is at an angle of between about 20° and about 60° relative to said first leg portion, said manipulating portion comprising a relatively straight portion of the rod which is substantially coplanar with said first leg portion, and said manipulating portion terminating in a finger grip ring which is coplanar with said manipulating portion.

27. The keyless automobile door unlocking apparatus as claimed in claim 26, wherein said third leg portion is bent so as to angle outwardly away from the second leg portion and then angled inwardly back towards the second leg portion, the bend angle in said third leg portion being between about 20° and about 60°.

28. The keyless automobile door unlocking apparatus as claimed in claim 26, wherein the hook portion is coated with an elastomeric, non-slip coating.

* * * * *